United States Patent [19]

Kitamura et al.

[11] 4,075,455

[45] Feb. 21, 1978

[54] FIXING DEVICE FOR AN ELECTROPHOTOGRAPHIC COPYING MACHINE

[75] Inventors: Ko Kitamura; Mamoru Watanabe; Yojiro Watanabe; Yutaka Seto, all of Hachioji, Japan

[73] Assignee: Konishiroku Photo Industry Co., Ltd., Tokyo, Japan

[21] Appl. No.: 709,523

[22] Filed: July 28, 1976

[30] Foreign Application Priority Data

July 30, 1975 Japan ..... 50-92070

[51] Int. Cl.[2] ..... G03G 15/20; H05B 1/00

[52] U.S. Cl. ..... 219/216; 219/388

[58] Field of Search ..... 219/216, 388; 355/3 FU; 250/317–319

[56] References Cited

U.S. PATENT DOCUMENTS

| | | | |
|---|---|---|---|
| 3,079,483 | 2/1963 | Codichini et al. | 219/216 |
| 3,408,476 | 10/1968 | Wahl | 219/388 |
| 3,934,112 | 1/1976 | Lakhani | 219/216 |

*Primary Examiner*—C. L. Albritton

*Attorney, Agent, or Firm*—Haseltine, Lake & Waters

[57] ABSTRACT

A fixing device for use in an electrophotographic copying machine comprising a fixing plate having a width substantially equal to the maximum width of recording sheets in use and a heater disposed transversely of a fixing plate. The heater is divided into heater sections in the direction of widths of the recording sheets corresponding to the widths thereof. A temperature sensing element is associated with each of the divided heater sections and supplied power to the heater sections is controlled in response to the output of the temperature sensing element.

6 Claims, 5 Drawing Figures

FIXING DEVICE FOR AN ELECTROPHOTOGRAPHIC COPYING MACHINE

FIELD OF THE INVENTION

This invention relates to a fixing device for use in an electrophotographic copying machine and more particularly a surface fixing device with its associated heater divided into heater sections corresponding to the widths of recording sheets so that the fixing temperature is properly controlled and fixing of good quality is attained for different sizes of the recording sheets in use. In the specification meant by the term "recording sheet" are a copying sheet having a photosensitive layer thereon, a plain paper onto which a toner image is transferred after developed and a plain paper onto which on electrostatic latent image is transferred prior to development thereof.

PRIOR ART

A surface fixing device has been used to fix toner images on a recording sheet by heating it. Use is made of an electric heating wire as a heat source in the surface fixing device and fixing is effected by heat radiation of a plate which has been preliminarily been heated. In this type of fixing devices, the whole plate is heated, and comparatively steady fixing is obtained even against sudden heat dissipation due to passage of the recording sheet as the plate has a large amount of heat capacity. If the heating plate is made to have a size corresponding to the maximum width of the recording sheets in use, even when sudden heat dissipation takes place in part of the plate with change in size of the recording sheet, quick movement of heat takes place within the plate, so that the whole plate is held at the uniform fixing temperature and does not cause defective fixing. However, in a copying machine using such fixing devices, copying operation cannot be started until heating of the plate by the electric heating wire is completed. Since a heating period of about five minutes is usually required, it is necessary to keep current flowing in the fixing device during the whole period of operation and maintain it at the fixing temperature. This results in an increase in power consumption and the cost of the maintenance of the copying machine.

As an improvement in the fixing devices, there has been proposed a method of reducing the time period required to reach the condition where fixing is possible from the start of current supply. For example, by abolishing such heating plate as afore-mentioned and instead covering the electric heating wire with a heat-resisting glass tube for preventing sudden heat radiation from the electric heating wire, it has been possible to realize that the heater of the fixing device is maintained at the fixing temperature of several hundred degrees and to reduce the time required for the fixing device to reach the condition ready for fixing after initiation of current supply. However, even with the afore-mentioned improved fixing device, the following defects result. For example, in the case where copying is made with recording sheets of different sizes by a copying machine having a size selecting means incorporated therein, it is natural to make the fixing device have its width conform to the maximum width of the recording sheets in use. Assuming now the case where an operator uses a great number of recording sheets all of smaller width (for instance size $A_4$) depending upon the size of an original, the recording sheets will pass a part of the whole width of the fixing device in the fixing process. As the recording sheet passes the fixing device, the fixing device is robbed of heat rapidly by the recording sheet on the area of the device facing the recording sheet with a resulting temperature reduction whereas the temperature will gradually increase on the remaining area of the fixing device as the area is subjected to no heat absorption. More precisely, as a temperature sensing element is disposed in the center of the fixing device, the temperature will decrease on the fixing device in the neighbourhood of the temperature sensing element owing to passage of the recording sheet with the result that power supply will be continued to the fixing device, while temperature increases considerably in the heated portion of the fixing device on the area where the recording sheet has not passed and where heat absorption did not take place. Therefore, as the fixing operation is continued, temperature difference between the area of the fixing device where the recording sheet passed and the remaining area is extremely increased with the result that the latter becomes overheated and thus there will be adverse effects upon the marginal portion of the recording sheet during fixing process. When copying is effected with a recording sheet of a greater width (for instance size $B_4$), the recording sheet will pass the overheated area of the fixing device at its marginal portion or portions, resulting in partial burning of the recording sheets.

SUMMARY OF THE INVENTION

The invention contemplates to removal of the aforementioned drawbacks. According to the invention, the heater associated with the fixing plate is divided into heater sections corresponding to different widths of recording sheets in use, the temperature of which heater sections is controlled to provide proper temperature for fixing by means of temperature sensing elements, thereby permitting satisfactory fixing for every size or width of the recording sheet. In other words, the effective portion of the heater is controlled depending upon the width of the recording sheets in use and the provision of temperature sensing elements in association with the effective portion of the heater will control the temperature properly for fixing of the recording sheets of different widths. The invention will now be described in conjunction with one embodiment thereof by reference to the accompanying drawings.

DETAILED DESCRIPTION

Figure 1:
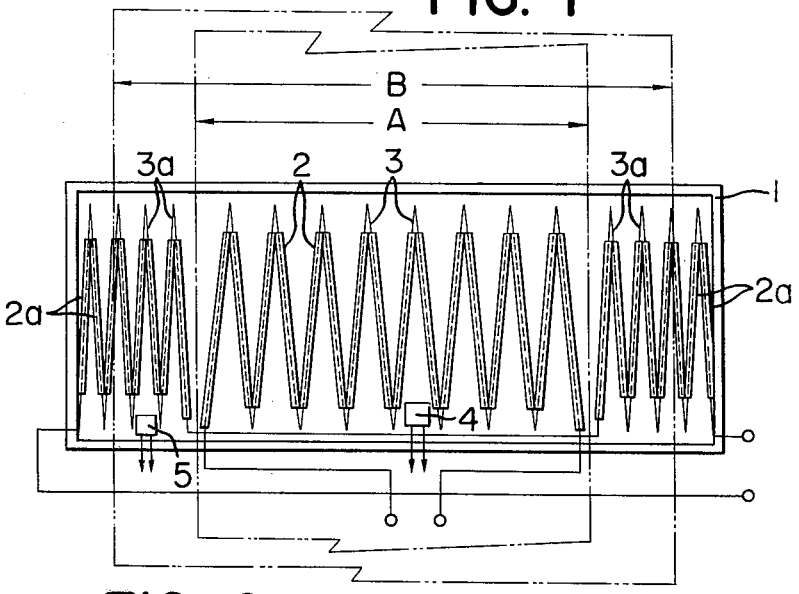
FIG. 1 is a front view of one embodiment of the fixing device according to the present invention with the heater divided into heater sections.

As shown in FIG. 1, there is disposed within a frame 1 having a width corresponding to the maximum width of the recording sheets in use, a first heater section consisting of an electric heating wire 3 covered with a heat insulating glass tube 2 and arranged in a central zone of the frame 1 in a zig-zag form, the width of which heater section corresponds to the width A of the narrowest recording sheet in use. There is also disposed within the fram 1 a second heater section consisting of electric heating wires 3*a*, similarly convered with heat insulating tubes 2 and disposed outside of the first heater section 3 in a zig-zag form, whose width corresponds to the width B of a broader recording sheet. The electric heating wires 3*a* are connected in series with each other to constitute the second heater section. Temperature detecting elements 4 and 5 are provided in the neighborhood of the central zone of the fixing device for detecting the quantity of heat generated by the first and second heater sections when the electric heating wires 3 and 3*a* are energized.

Figure 2:
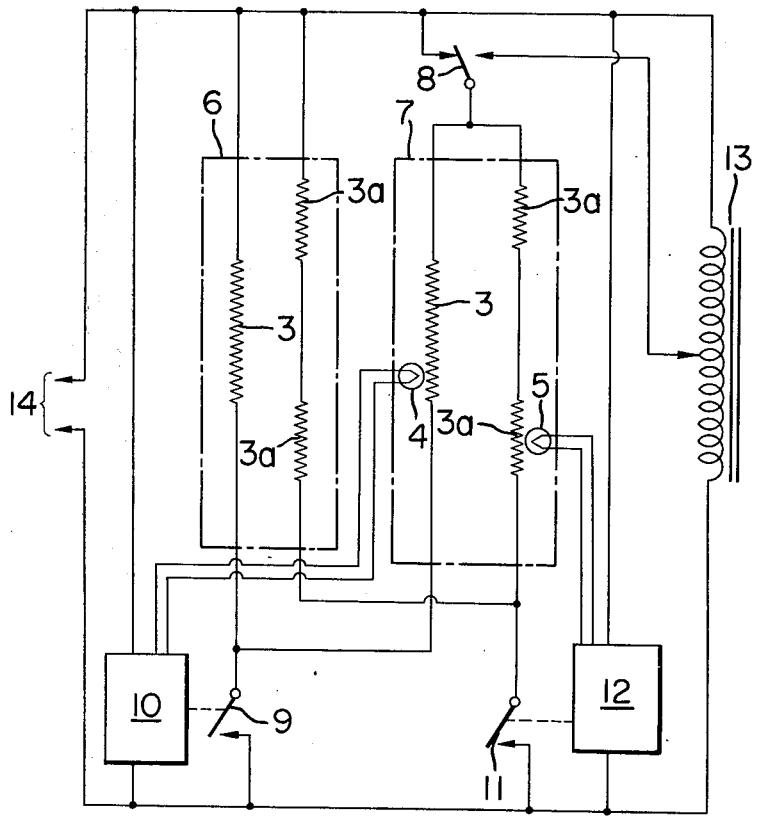
FIG. 2 is a circuit diagram of a control circuit for controlling the temperature of the heater sections.

Explanation will now be given to the circuit for controlling the temperature of the first and second heater sections as shown in FIG. 2. The circuit is arranged to heat a recording sheet both from above and from below thereof. Designated at 6 is an upper heating section, and at 7 a lower heating section. The sections 6 and 7 collectively constitute a fixing plate. Each of the upper and lower heating sections include the afore-mentioned first and second heater sections. In the lower heating section 7, the electric heating wire 3 associated with the narrow recording sheet A constitutes the first heater section and the electric heating wires 3*a*, 3*a* associated with the broader recording sheet B constitute the second heater section. One end of the electric heating wire 3 and one end of one of the electric heating wires 3*a* are connected to a common selecting switch 8 for the purpose hereinafter described. On the other hand, in the upper heating section 6, the electric heating wire 3 corresponding to the narrow recording sheet A and the electric heating wires 3*a* corresponding to the broader recording sheet B are arranged in the same positional relation as those of the lower heating section 7. A switch 9 is provided common to the electric heating wires 3 of both the upper and lower heating sections 6 and 7 and is on-off controlled by a controller 10 which is operated in response to the signal from temperature sensing element 4 for detecting the temperature of the electric heating wire 3 of the lower heating section 7. Common to the electric heating wires 3*a* of both the upper and lower heating sections 6 and 7 is provided another switch 11 which is controlled by a controller 12 which is operated in response to the signal from a temperature sensing element 5 associated with the electric heating wire 3*a* of the lower heating section 7. The select switch 8 is operated at the time when an exposure lamp (not shown) is turned on and one of the contacts of the switch 8 is connected to a variable power supply means 13, which serves to control electric power supplied to the lower heating section 7. Electric power is usually supplied from a power source 14. For these switches 9 and 11, it is of course possible to use contactless switches such as a silicon controlled rectifier (SCR).

Figure 3:
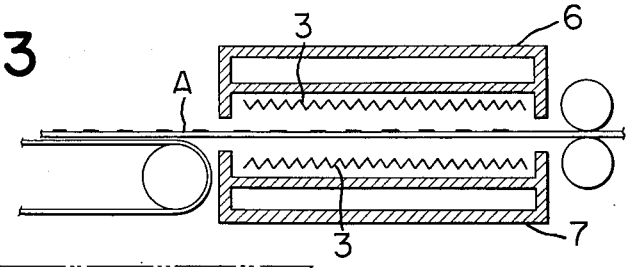
FIG. 3 is a schematic side view of the arrangement of the fixing device.

When current is caused to flow in the first and second heater sections of the upper and lower heating sections 6 and 7 in the fixing device of the above construction, the temperature of the upper and lower heating sections 6 and 7 is quickly increased. When the fixing temperature is exceeded, the controllers 10 and 12 are operated by means of the temperature sensing elements 4 and 5 to open the switches 9 and 11, so that the heating temperature of the upper and lower heating sections 6 and 7 is maintained at the fixing temperature. Under such condition, it is now assumed that a narrow recording sheet A is inserted into the gap between the upper and lower heating sections 6 and 7 as shown in FIG. 3 to carry out fixing of the sheet A. At this time, the recording sheet A passes the area on the fixing plate corresponding to the first heater section or more particularly the electric heating wire 3 as shown in FIG. 1. In case only several sheets of such narrow width pass the area, a little amount of heat is absorbed by the narrow recording sheet A from the heat generated by the electric heating wire 3, and there is little decrease in temperature. However, in case of a great number of copies being made, the temperature decrease becomes greater over the width of the narrow recording sheet A, that is, the area of the fixing plate corresponding to the first heater section of the lower heating section 7. In this case, the switch 9 is always kept in closed position by the controller 10 in response to the temperature detection by the temperature sensing element 4. Thus electric power is supplied to the first heater section or the electric heating wire 3 and a proper fixing condition is maintained. On the other hand, no recording sheet passes the area of the second heater section or the electric heating wires 3*a* corresponding to the width of the broader recording sheet B, so that a sudden temperature increase takes place. However, the second heater section is prevented from raising its temperature by means of the controller 12 which has previously been set so as not to allow the temperature of the second heater section to exceed a predetermined level, for example the temperature level at which the recording sheet may be burnt by overheat, in response to temperature detection of the temperature sensing element 5. When the copying operation is again started with a broad recording sheet B, satisfactory fixing can be obtained since the second heater section provided on the outside of the first heater section is always kept at a proper temperature for the fixing. In this case, the areas corresponding to the first and the second heater sections are subjected to heat absorption due to passage of the broad recording sheet B, but the controllers 10 and 12 are controlled by the temperature sensing elements 4 and 5 to close switches 9 and 11 so as to maintain the fixing temperature. An exposure halogen lamp requires large power to turn on and then the switch 8 is tentatively changed over so as to reduce the power supplied to the electric heating wires 3 and 3*a* of the lower heating section 7. In this way, suitably controlled power is supplied through the variable power supply means 13 to the lower heating section 7. The extent of power control is adjusted according to the permissible power for the copying machine.

Figure 4:
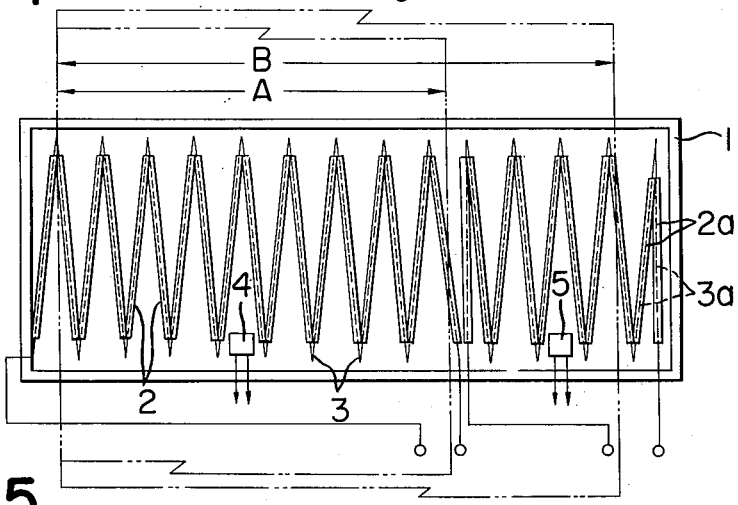
FIG. 4 is a front view of another embodiment of the fixing device and FIG. 5 is a control circuit diagram of another, embodiment.
Figure 5:
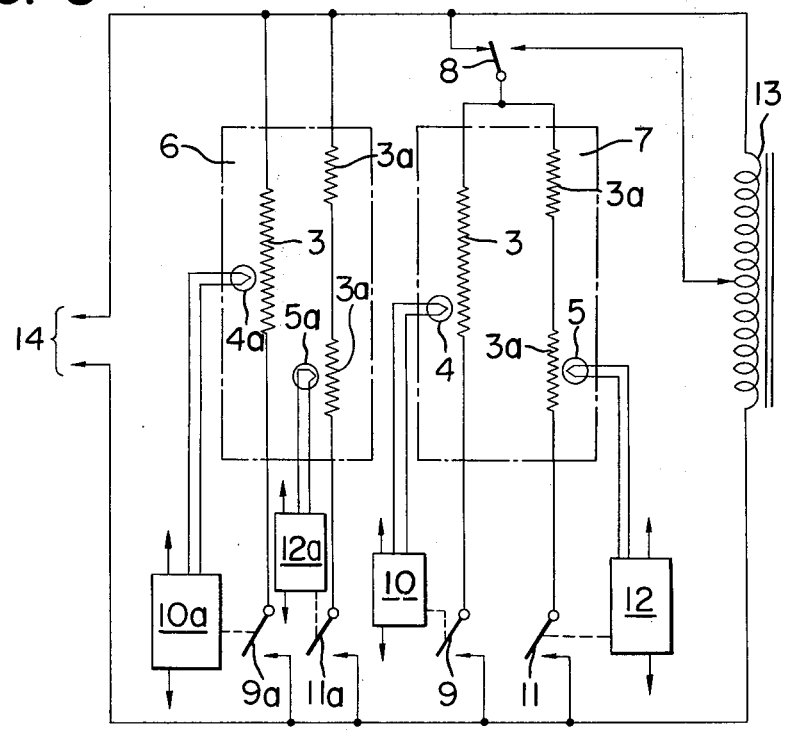

FIG. 4 shows another embodiment of the arrangement of the electric heating wires 3 and 3*a* for different passage of recording sheets, for example laterally displaced passage. As shown in the drawing, the first heater section, i.e., the electric heating wire 3 is located within the frame 1 in the area adjacent to one lateral side of the fixing plate which area covers the passage for the narrow recording sheet A. The second heater section, i.e., the electric heating wire 3*a* is located in the area adjacent to the other lateral side of the fixing plate. The electric heating wires 3 and 3*a* cover together the width of the broader recording sheet B. Temperature sensing elements 4 and 5 for detecting the heating temperature as in the aforementioned embodiment are provided in the center of the electric heating wires 3 and 3*a*, respectively.

While in the embodiment described by reference to FIG. 2, the temperature sensing elements 4 and 5 are provided in association with the electric heating wires 3 and 3*a* of the lower heating section 7 for controlling the temperature of the whole system by the controllers 10 and 12, temperature sensing elements 4*a* and 5*a* may additionally be provided in association with the electric heating wires 3 and 3*a* of the upper heating section 6. In this case, additional controllers 10*a* and 12*a* may also be provided in association with the temperature sensing elements 4*a* and 5*a*, respectively for controlling the temperature of the electric heating wires 3 and 3*a* of the upper heating section 6. With the additional sensing elements 4*a* and 5*a* and the additional controllers 10*a* and 12*a* thus arranged, it can be assured that no sudden change in temperature will occur upon failure of some of the temperature sensing elements or the controllers and safety can be assured.

As has been described in the foregoing, according to the invention, an electric heater is arranged in association with the fixing plate in the form of divided heater sections corresponding to the widths of the recording sheets in use, and temperature of the heater sections is controlled respectively to fall within the range suitable for fixing. The temperature of the area or zone on the fixing plate on which the recording sheet passes when fixed and the remaining area or zone on which the recording sheet does not pass is separately controlled so that the whole surface of the fixing plate is maintained at a constant fixing temperature. Accordingly, satisfactory fixing can always be obtained even with alteration of the width of the recording sheet, that is, for different size of the recording sheets.

What we claim is:

1. A fixing device for use in an electrophotographic copying machine comprising a fixing plate having a width substantially equal to the maximum width of recording sheets in use and a heater disposed transversely of the fixing plate, said heater being divided into heater sections in the direction of width of the recording sheets corresponding to the widths thereof, and a temperature sensing element associated with each of the divided heater sections and means for controlling supply of power to said heater sections in response to the output of said temperature sensing elements.

2. A fixing device as set forth in claim 1 wherein the heater section substantially corresponding to the minimum width of recording sheets in use is disposed in the central zone of the fixing plate.

3. A fixing device as set forth in claim 1 wherein the heater section substantially corresponding to the minimum width of recording sheets in use is disposed adjacent to one lateral side of the fixing plate.

4. A fixing device for use in an electrophotographic copying machine comprising a pair of fixing plates between which recording sheets pass to be fixed, each fixing plate having a width substantially equal to the maximum width of recording sheets in use, and a pair of heaters each disposed transversely of and in association with each of the fixing plates, each heater being divided into heater sections in the direction of width of the recording sheets corresponding to the widths thereof, and a temperature sensing element associated with each of the divided heater sections for at least one of the pair of heaters and means for controlling supply of power to said heater sections in response to the output of said temperature sensing elements.

5. A fixing device as set forth in claim 4 wherein the heater sections substantially corresponding to the minimum width of recording sheets in use are disposed in the central zone of the fixing plates.

6. A fixing device as set forth in claim 4 wherein the heater sections substantially corresponding to the minimum width of recording sheets in use are disposed adjacent to one lateral side of the fixing plates.

* * * * *